US005232001A

United States Patent [19]

Machelett

[11] Patent Number: 5,232,001

[45] Date of Patent: Aug. 3, 1993

[54] COSMETICS COMPACT

[75] Inventor: Dietrich Machelett, Meinerzhagen, Fed. Rep. of Germany

[73] Assignee: Wilhelm Koopmann KG, Meinerzhagen, Fed. Rep. of Germany

[21] Appl. No.: 955,688

[22] Filed: Oct. 2, 1992

[30] Foreign Application Priority Data

Sep. 24, 1992 [EP] European Pat. Off. ..... 92116311.9

[51] Int. Cl.[5] ..... A45D 33/00

[52] U.S. Cl. ..... 132/293; 206/823; 220/DIG. 26

[58] Field of Search ..... 132/293, 295, 296, 300, 132/301, 315; 206/823; 220/DIG. 26

[56] References Cited

U.S. PATENT DOCUMENTS 4,679,576 7/1987 Yuhara et al. ..... 132/293
4,685,558 8/1987 Filiz et al. ..... 220/DIG. 26 X
4,799,503 1/1989 Tahara ..... 220/DIG. 26 X
4,834,122 5/1989 Yuhara et al. ..... 132/293 X
4,989,622 2/1991 Kozuka et al. ..... 132/293 X

*Primary Examiner*—Robert P. Swiatek
*Attorney, Agent, or Firm*—Edwin D. Schindler

[57] ABSTRACT

A cosmetics compact having a shell-shaped housing lower part, a powder tray and/or insert containing the like inside the housing lower part and a lid coupled by way of a hinge, having matching pairs of hook-like detent elements for locking lid and housing lower part, with a first detent element being integrally formed in one piece on the lid, as well as having a presser for releasing the detent elements. The technical problem is reliable guidance of the presser over a long displacement path and high strength of the detent elements, also inexpensive manufacture and ease of operation for the user. The second detent element is seated in one piece on the housing lower part. The presser is connected via a V-shaped carrier to the insert and is rectilinearly guided in an opening in the housing lower part, and projections of the presser may be brought into engagement with the first detent element.

6 Claims, 2 Drawing Sheets

COSMETICS COMPACT

BACKGROUND OF THE INVENTION

1. Field of the Invention

The invention relates to a cosmetics compact, having a shell-shaped housing lower part, a powder tray and/or insert containing the like inside the housing lower part and a lid coupled by way of a hinge, having matching pairs of hook-like detent elements for locking lid and housing lower part, with a first detent element being integrally formed in one piece on the lid, as well as having a presser for releasing the detent elements.

2. Description of the Prior Art

Reliable unlocking of the detent elements requires an adequate travel for said elements and for the presser so that, even taking tolerances into account, the cosmetics compact may be opened effortlessly. The parts have to be sufficiently robust and be guided in a smooth and ergonomically advantageous manner.

SUMMARY OF THE INVENTION

The aim of the invention is reliable guidance of the presser over a long displacement path and high strength of the detent elements, also inexpensive manufacture and ease of operation for the user.

Said aim is achieved according to the invention in that the second detent element is seated in one piece on the housing lower part, and that the presser is connected via a V-shaped carrier to the insert and is rectilinearly guided in an opening in the housing lower part, and that projections of the presser may be brought into engagement with the first detent element.

The invention differs from prior art in that the detent element connected to the base of the housing lower part is, for unlocking, deformable over the entire height of the housing lower part. The path of deformation is therefore very great. The presser, on the other hand, may be rectilinearly adjusted over a long distance. The presser acts upon a long lever arm of the detent element so that the required actuating force is low. From an ergonomic point of view, the rectilinear guidance of the presser is advantageous for the user; for any horizontal swinging of the presser is felt to be unpleasant. Swivelling movements are transferred exclusively into the detent elements and, during actuation, are imperceptible to the user.

Uniform guidance of the presser is provided in that a plurality of carriers are provided for the presser.

Rectilinear and swing-free guidance of the presser is achieved in that guide beads of the presser are guided on undercut edges of the opening in the front wall.

Reliable closure is guaranteed by the fact that lugs of the detent elements with shaped surfaces engage one in the other.

Damage to the detent elements during the closure process is excluded in that the detent elements have shaped surfaces, which are inclined in closing direction and ensure that the detent elements slide one over the other during the closing process.

Raising of the lid upon opening is ensured in that a shaped surface of the presser cooperates during the opening process with a shaped surface of the first detent element in the sense of raising the lid.

BRIEF DESCRIPTION OF THE DRAWINGS

Embodiments of the invention are described below with reference to the drawings, which show.

DESCRIPTION OF PREFERRED EMBODIMENTS

Figure 1:
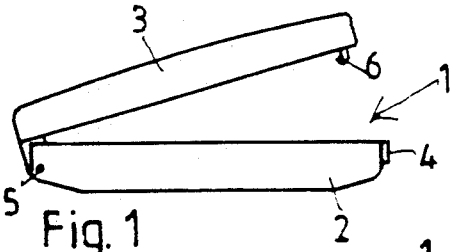
FIG. 1 a view of a partially open cosmetics compact.
Figure 2:
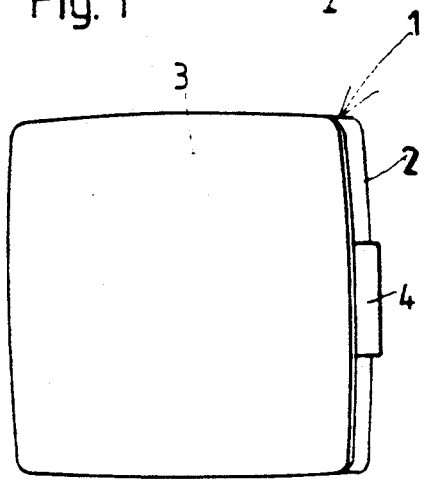
FIG. 2 a plan view of FIG. 1.

FIGS. 1 and 2 are diagrammatic views of a cosmetics compact 1 comprising a shell-shaped housing lower part 2 with a presser 4 and a lid 3. The lid 3 is connected by a hinge 5 to the housing lower part 2. A first detent element 6 is integrally formed in one piece in the lid 3. The second detent element 7 is of a plate-like construction and is integrally formed in one piece on the base 8 of the housing lower part 2, as is evident from FIG. 3. By actuating the presser 4, which projects out of the front wall 10 of the housing lower part 2, the lid 3 is unlocked as in FIG. 1. The cosmetics compact may then be effortlessly opened. The housing lower part, the lid and the insert are advantageously thermoplastic injection-moulded parts made of the same or differing thermoplastic materials.

The housing lower part 2 is shell-shaped and contains an insert 9 for a powder tray. The insert 9 may be made of a softer material than the lid 3 and the housing lower part 2. The presser 4 is formed via one or more V-shaped carriers 11 on the insert 9, e.g. on one of its side walls. The carriers 11 are strip-like, i.e. as thin and deformable as possible, so that the presser 4 may be moved with a low expenditure of force.

Figure 3:
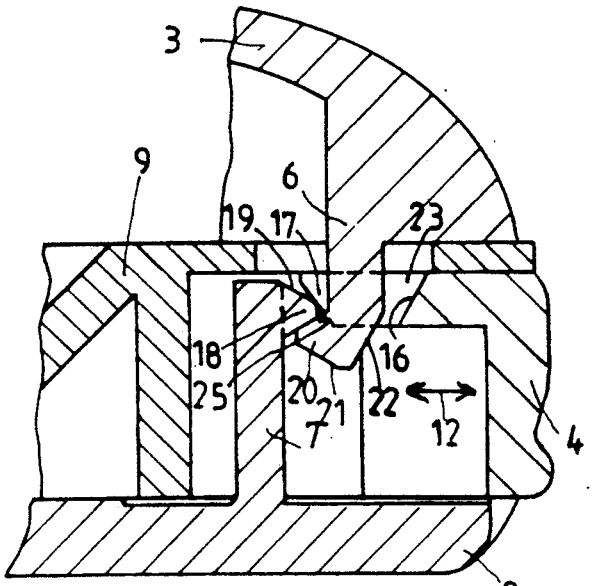
FIG. 3 a part-sectional view with details of the detent elements in the closed state, FIG. 4 a part-sectional view illustrating the open state, FIG. 5 a front view of the front wall with the presser, and FIG. 6 a plan view of FIG. 5.
Figure 5:
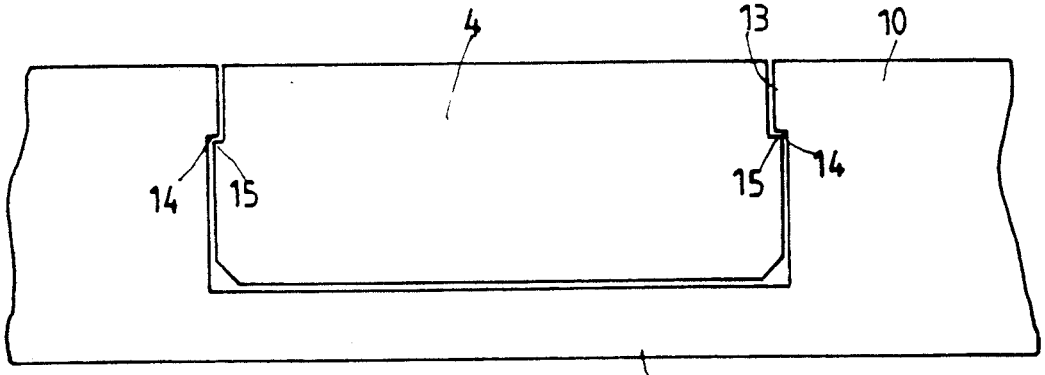
Figure 6:
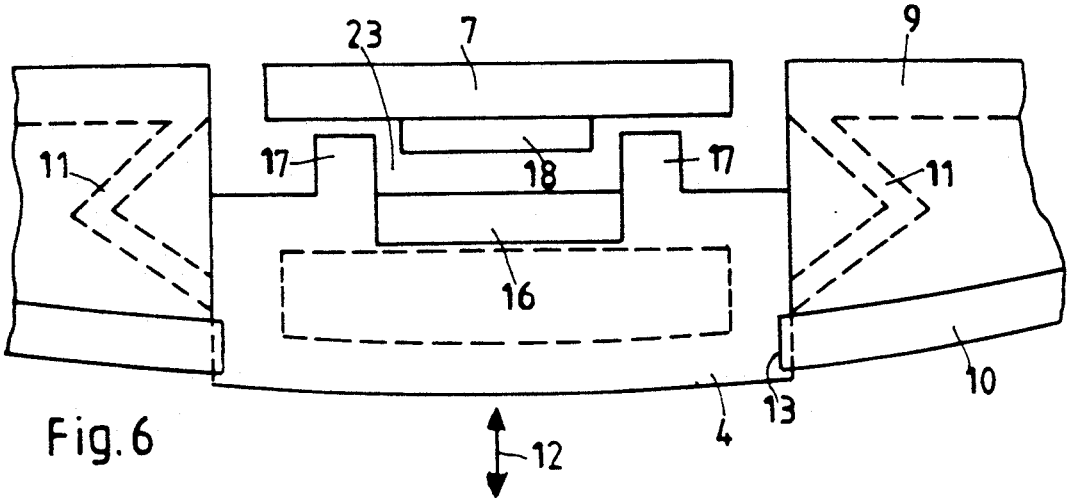

The presser 4 projects through an opening 13 in the front wall 10 of the housing lower part 2 and is movable in the directions of the double arrow 12, FIGS.3 and 6. The carriers 11 constitute a resilient guide and also provide a restoring force. The opening 13 has undercut edges 14, into which guide beads 15 of the presser 4 engage. Rectilinear guidance of the presser 4 is thereby ensured. Provided on the inside of the presser 4 are, on the one hand, a shaped surface 16 inclined in the direction of movement and, on the other hand, peg-shaped projections 17 which, on movement of the presser, engage with the detent element 7. The faces 25 of the projections 17 are inclined so that the projections 17 engage with the top end of the detent element 7.

The detent element 7 is substantially plate-like in construction and has at its top end a lug 18 with a shaped surface 19 inclined towards the plane of the plate. The detent surface of the lug 18 is also inclined. The detent element 7, with the shaped surface 16 and the projections 17 of the presser 4, delimits a slot 23.

Figure 4:
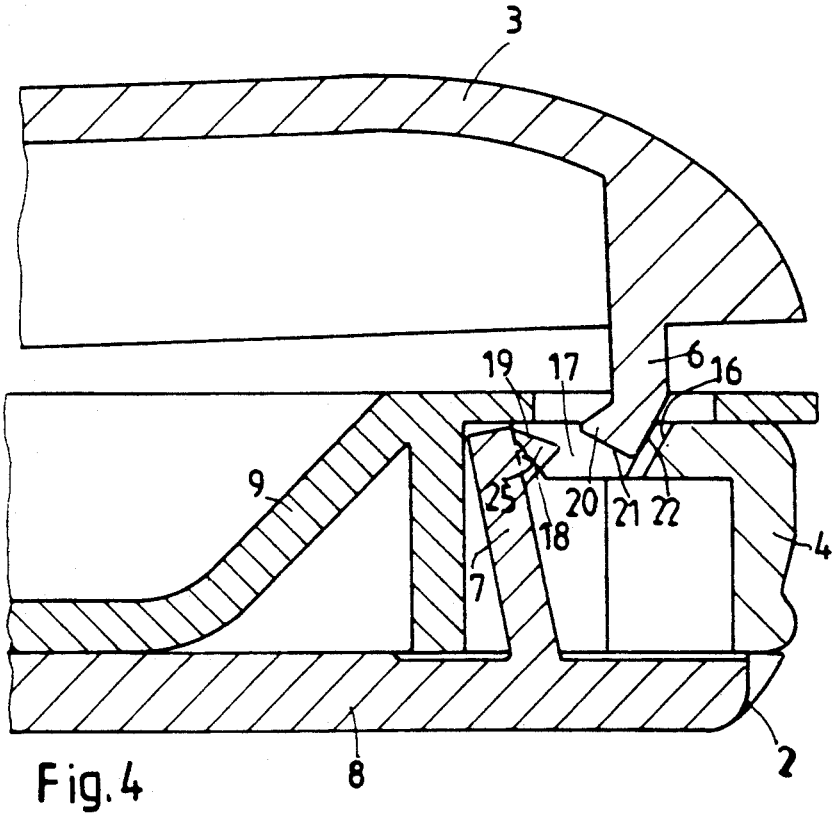

The detent element 6 of the lid 3 has a lug 20, which is shaped so as to be substantially complementary to the lug 18. A shaped surface 21 is inclined in accordance with the shaped surface 19. A shaped surface 22 is also provided, which is constructed so as to match the shaped surface 16. The detent element 6 is so dimensioned that it fits through the slot 23. FIG. 3 shows the detent elements in the closed state. The detent element 6 lies with its lug 20 against the lug 18 of the detent element 7. The cosmetics compact 1 is held closed by the inclined detent surfaces of the lugs 18 and 20 and by the restoring force of the detent elements 6 and 7. For opening, the presser 4 is pressed inwards. The detent element 7 is deformed as in FIG. 4, so that the lugs 18 and 20 disengage from one another. Furthermore, as a result of the action of the shaped surfaces 16 and 22, the lid 3 is raised, as is evident from FIG. 4. This may however also be achieved in some other way.

To ensure that the detent elements 6 and 7 attain the closed position, the shaped surfaces 19 and 21 are provided, which cause the detent elements to yield upon closure of the cosmetics compact.

I claim the following:

1. Cosmetics compact having a shell-shaped housing lower part, a powder tray and/or insert containing the like inside the housing lower part and a lid coupled by way of a hinge, having matching pairs of hook-like detent elements for locking lid and housing lower part, with a first detent element being integrally formed in one piece on the lid, as well as having a presser for releasing the detent elements, characterized in that the second detent element is seated in one piece on the housing lower part, and that the presser is connected via a V-shaped carrier to the tray and/or insert and is rectilinearly guided in an opening in the housing lower part, and that projections of the presser may be brought into engagement with the first detent element.

2. Cosmetics compact according to claim 1, characterized in that a plurality of carriers are for the presser.

3. Cosmetics compact according to claim 1, characterized in that guide beads of the presser are guided on undercut edges of the opening in the front wall.

4. Cosmetics compact according to claim 1, characterized in that lugs of the detent elements have shaped surfaces engaging one in the other.

5. Cosmetics compact according to claim 1, characterized in that the detent elements have shaped surfaces, which are inclined in a closing direction and ensure that the detent elements slide one over the other during the closing process.

6. Cosmetics compact according to claim 1, characterized in that a shaped surface of the presser cooperates during the opening process with a shaped surface of the first detent element in the sense of raising the lid.

* * * * *